US008426989B2

(12) United States Patent
Usami et al.

(10) Patent No.: US 8,426,989 B2
(45) Date of Patent: Apr. 23, 2013

(54) STARTER FOR VEHICLES EQUIPPED WITH AUTOMATIC ENGINE STOP/RE-STARTING DEVICE

(75) Inventors: Shinji Usami, Okazaki (JP); Yasuyuki Yoshida, Chita-gun (JP); Mitsuhiro Murata, Niwa-gun (JP); Masami Niimi, Handa (JP)

(73) Assignee: Denso Corporation, Kariya (JP)

( * ) Notice: Subject to any disclaimer, the term of this patent is extended or adjusted under 35 U.S.C. 154(b) by 154 days.

(21) Appl. No.: 12/758,430

(22) Filed: Apr. 12, 2010

(65) Prior Publication Data

US 2010/0264764 A1 Oct. 21, 2010

(30) Foreign Application Priority Data

Apr. 15, 2009 (JP) ..... 2009-098920

(51) Int. Cl.
*F02N 11/00* (2006.01)

(52) U.S. Cl.
USPC ..... 290/38 R

(58) Field of Classification Search ..... 290/38 R, 290/48; 335/126, 127, 131; 74/7 R
See application file for complete search history.

(56) References Cited

U.S. PATENT DOCUMENTS

| | | | | |
|---|---|---|---|---|
| 5,892,422 | A * | 4/1999 | Montaigu et al. | 335/126 |
| 6,380,831 | B1 * | 4/2002 | Kajino | 335/127 |
| 6,486,762 | B2 | 11/2002 | Kurasawa et al. | |
| 2004/0032309 | A1 | 2/2004 | Kajino et al. | |
| 2007/0068288 | A1 | 3/2007 | Hasegawa et al. | |
| 2009/0002105 | A1 * | 1/2009 | Bradfield et al. | 335/187 |
| 2009/0183595 | A1 * | 7/2009 | Niimi | 74/7 R |
| 2010/0033066 | A1 | 2/2010 | Murata et al. | |

FOREIGN PATENT DOCUMENTS

| | | | |
|---|---|---|---|
| JP | Y2-56-42437 | | 10/1981 |
| JP | U-57-147539 | | 9/1982 |
| JP | A-7-253072 | | 10/1995 |
| JP | A-11-30173 | | 2/1999 |
| JP | A-2002-138931 | | 5/2002 |
| JP | A-2002-168166 | | 6/2002 |
| JP | A-2003-3938 | | 1/2003 |
| JP | 200383212 | * | 3/2003 |
| JP | A-2003-83212 | | 3/2003 |
| JP | A-2004-76650 | | 3/2004 |
| JP | 2004-241297 | | 8/2004 |
| JP | A-2007-85276 | | 4/2007 |
| JP | A-2009-191843 | | 8/2009 |
| JP | A-2010-38103 | | 2/2010 |

OTHER PUBLICATIONS

Jan. 8, 2013 Office Action issued in Japanese Patent Application No. 2009-098920 (with translation).

* cited by examiner

*Primary Examiner* — Tho D Ta
(74) *Attorney, Agent, or Firm* — Oliff & Berridge, PLC

(57) ABSTRACT

A solenoid for pushing out a pinion pushes out a pinion gear to a ring gear side and a switch for motor energization that opens and closes a motor point of contact have a solenoid coil and a switch coil that form an electromagnet by energization, respectively. A fixed iron core used commonly by both coils is arranged between the solenoid coil and the switch coil. A solenoid yoke that covers a perimeter of the solenoid and a switch yoke that covers a perimeter of the switch are formed integrally as a whole yoke in an axial direction.

3 Claims, 3 Drawing Sheets

STARTER FOR VEHICLES EQUIPPED WITH AUTOMATIC ENGINE STOP/RE-STARTING DEVICE

CROSS-REFERENCE TO RELATED APPLICATION

This application is based on and claims the benefit of priority from earlier Japanese Patent Application No. 2009-98920 filed Apr. 15, 2009, the description of which is incorporated herein by reference.

BACKGROUND OF THE INVENTION

1. Technical Field of the Invention

The present invention relates to a starter for vehicles having a solenoid for pushing out a pinion gear to a ring gear side, and a switch for turning on and off an energization current of a motor.

2. Description of the Related Art

In recent years, there has been an increase of vehicles equipped with an automatic engine stop/re-starting device (hereafter called an idle stop system) for the purpose of reducing carbon dioxide and improving fuel consumption.

The idle stop system will cut fuel supply to the engine for stopping the engine automatically when predetermined condition is satisfied when the vehicle is stopped (idling state) or during reducing the engine speed.

Then, when starting operations (for example, releasing brakes, shifting to a drive range, etc.) are performed by the user and starting conditions are satisfied, the system operates a starter automatically and re-starts the engine.

The idle stop system has many opportunities to stop the engine automatically on a street, such as when stopping at a crossing and stopping in a traffic jam.

Therefore, when starting conditions are satisfied, it is required that engine should be reliably re-started as promptly as possible.

Then, the necessity of separating the starter functions of pushing out the pinion gear and a function of turning on and off the energization current of the motor arises as.

As a conventional technology in which this is realizable, there is a starter disclosed in the Japanese Utility Model Application Second Publication No. 56-42437.

This starter has a solenoid that generates the driving force (attractive force of an electromagnet) for pushing out a pinion gear to a ring gear side via a shift lever and a switch that turns on and off an energization current of a motor, and both the solenoid and the switch are constituted separately.

By the way, although the loading position of the starter in an engine compartment is usually a place close to and beside the engine, however, functional components with a higher priority for the engine performance, such as an intake manifold, are arranged around the engine in many cases.

For this reason, the outer diameter size of the starter used only for starting the engine is often restricted. Therefore, in order to secure the market competitiveness of the product itself, improving an ease of arrangement of the starter by miniaturization is important.

However, the starter disclosed in above-mentioned prior art document has the solenoid for pushing out the pinion and the switch for energizing the motor arranged in parallel.

That is, the solenoid for pushing out the pinion and the switch for energizing the motor are arranged in a position that is different from the circumferential direction of the motor.

With the above-mentioned composition, the radial size of the motor and starter combination increases both radial axes.

Therefore, it is difficult to avoid interference with the functional components arranged around the engine, and it is difficult to arrange the components efficiently.

Further, since the solenoid for pushing out the pinion and the switch for energizing the motor shown in above-mentioned prior art document are constituted completely separately, parts cannot be shared commonly among both.

For this reason, a problem arises that the number of parts increases as compared with the conventional electromagnetic switch for starters.

In addition, when the solenoid for pushing out the pinion and the switch for energizing the motor are assembled, the process of crimping ends of a solenoid yoke and a switch yoke is required.

In this case, since it is necessary to cut an inner circumference of the yoke thin in order to provide a crimping portion at the end of the yoke, a number of processes increases and workability is not efficient, either.

SUMMARY OF THE INVENTION

The present invention has been made in order to solve the issue described above, and has as its object to provide a starter for vehicles that can improve the ease of assembly in vehicles, reduce the number of parts, and offer improved workability.

In a starter for vehicles according to a first aspect, there is provided the starter for vehicles includes a motor that generates torque by energization, an output shaft receives the torque of the motor and rotates, a pinion movable body movably provided in an axial direction on a perimeter of the output shaft that has a pinion gear for transmitting the torque of the motor to a ring gear of an engine, a solenoid for pushing out the pinion that pushes out the pinion movable body in the axial direction by using an attractive force of an electromagnet formed by energizing a solenoid coil, and a switch for energizing the motor that turns on and off an energization current of the motor by using an attractive force of an electromagnet formed by energizing a switch coil.

The starter controls operations of the solenoid and the switch separately and independently. The solenoid and the switch are arranged in the axial direction in series, a fixed iron core common to both the solenoid and the switch is arranged between the solenoid coil and the switch coil. A solenoid yoke that covers a perimeter of the solenoid and a switch yoke that covers a perimeter of the switch are formed integrally as a whole yoke.

Since the solenoid for pushing out the pinion and the switch for energizing the motor are arranged in series in the axial direction in the starter of the present invention, radial size does not increase in the motor.

Since the restrictions on the size in respect of loading can be made small as compared with the starter of the prior art document that has arranged the solenoid for pushing out the pinion and the switch for energizing the motor in a position that is different in the circumferential direction of the motor, the ease of assembly to the vehicles improves.

In other words, ease of assembly equivalent to the conventional starter that performs the work of pushing out the pinion gear and turning on and off the energization current of the motor by using one electromagnetic switch is obtainable.

In addition, the fixed iron core common to both the solenoid and the switch is arranged between the solenoid coil and the switch coil.

In addition, the solenoid yoke and the switch yoke are formed integrally as a whole yoke.

Thereby, as compared with the case where the solenoid and the switch are constituted separately, the number of the parts can be reduced and the number of the assembly steps can also be reduced.

In the starter for vehicles according to a second aspect, wherein the whole yoke has a bottomed cylindrical shape with a circular bottom surface at its end portion on an end side in an axial direction and an opening in an opposite end side, an outer diameter of the whole yoke from one end to an opposite in the axial direction has the same size, the end in the axial direction that forms the switch yoke has a thinner edge than that of the solenoid yoke, the switch has a resin cover that fixes two terminal bolts connected to the energization circuit of the motor, and the resin cover is fixed by crimping to an opening of the whole yoke where the thinner edge is provided.

In the starter for vehicles according to a third aspect, wherein a magnetic path forming member is arranged that forms a part of a magnetic path on a perimeter side in a radial direction of the switch coil in an inner circumference of the opening of the whole yoke where the thinner edge is provided In the starter for vehicles according to a fourth aspect, wherein a step portion is provided in an inner circumference of the whole yoke between the one end in the axial direction that forms the solenoid yoke and the other end in the axial direction that forms the switch yoke, the fixed iron core is inserted into the inside of the one end in the axial direction that forms the switch yoke from an opening end that opens at the other end of the whole yoke, and the perimeter of an end surface of the fixed iron core in the axial direction is contacted with the step portion provided in the inner circumference of the whole yoke so that the position of the fixed iron core in the axial direction is set.

DETAILED DESCRIPTION OF PREFERRED EMBODIMENTS

Figure 1:
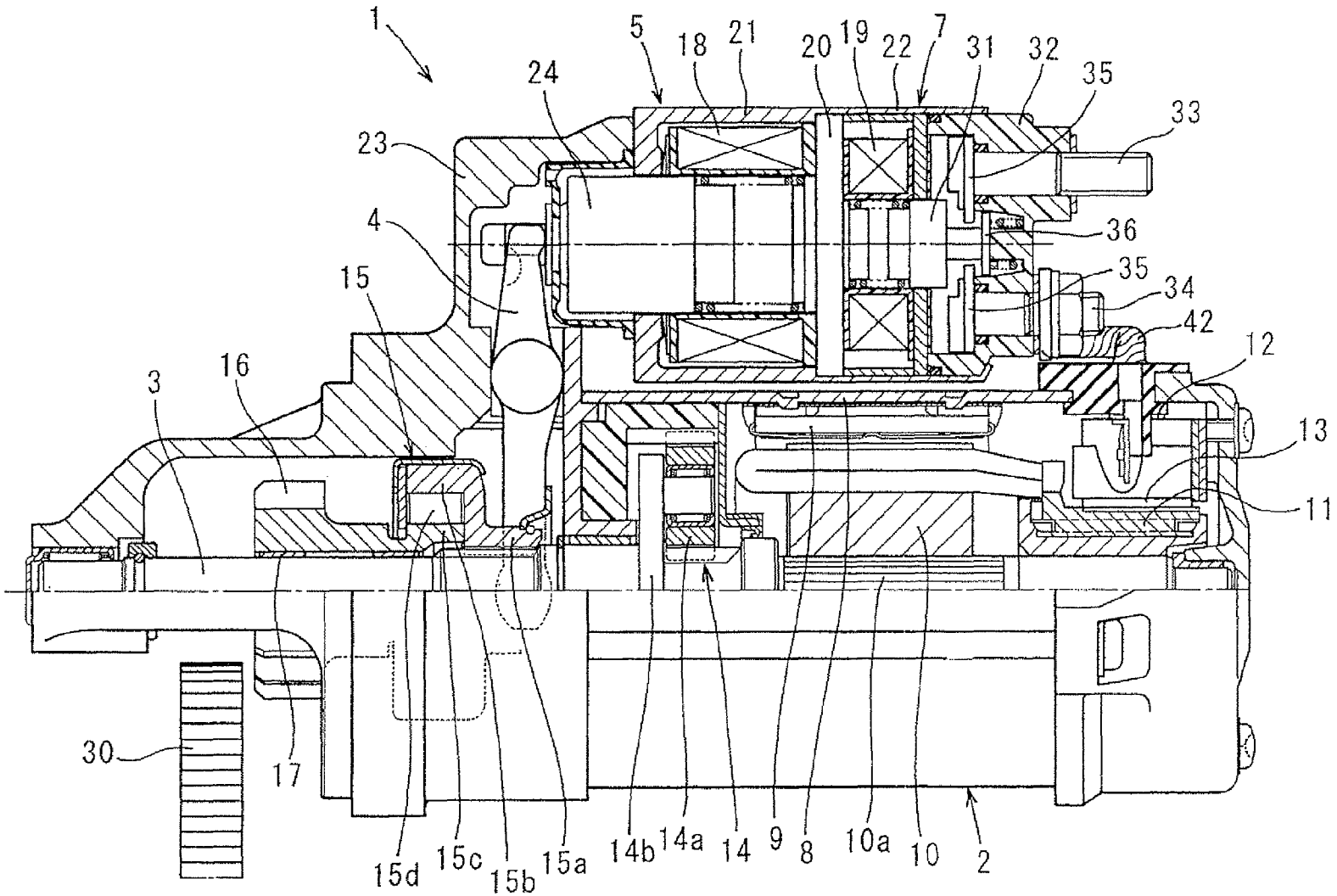
FIG. 1 shows a sectional view of a starter.

Preferred embodiments according to the present invention will be described with reference to the drawings.

(First Embodiment)

A starter 1 of this embodiment can be applied to an idle stop system that controls stopping and re-starting of an engine automatically.

As shows in FIG. 1, the starter 1 has a motor 2, an output shaft 3, a pinion movable body (mentioned later), shift lever 4, a solenoid 5 for pushing out a pinion, a battery 6 (refer to FIG. 3), and a switch 7 for motor energization.

The motor 2 generates torque, and this torque is transmitted to the output shaft 3 to make it rotate. The pinion movable body is movably provided in an axial direction on a perimeter of the output shaft 3. The solenoid 5 pushes out the pinion movable body in an anti-motor direction (to the left of FIG. 1) via the shift lever 4. The switch 7 opens and closes a motor point of contact provided in a motor circuit for passing current to the motor 2 from the battery 6 (referring to FIG. 3).

The motor 2 is a commutator motor provided with a magnetic field constituted by arranging a plurality of permanent magnets 9 in an inner circumference of a yoke 8, an armature 10 provided with a commutator 11 on an end of an armature shaft 10*a*, and brushes 13 arranged contacting with a perimeter of the commutator 11 (called a commutator side) and being pressed to the commutator side by brush springs 12.

The electromagnet field generated by a field coil can also be used for the magnetic field of the motor 2 instead of the permanent magnets 9.

The output shaft 3 is arranged coaxially with the armature shaft 10*a* via reduction gears 14, and a speed of the motor 2 is slowed down by the reduction gears 14, and then transmitted.

The reduction gears 14 are commonly known planetary reduction gears, and a planet carrier 14*b* that receives the orbital motion of a planetary gear 14*a* is provided integrally with the output shaft 3.

The pinion movable body comprises a clutch 15 and a pinion gear 16.

The clutch 15 is a commonly known one-way clutch and is constitute of a spline barrel 15*a* that fits the perimeter of the output shaft 3 in a helical spline manner, an outer clutch 15*b* provided integrally with the spline barrel 15*a*, an inner clutch 15*c* arranged relatively rotation free to the inner circumference of the outer clutch 15*b*, and rollers 15*d* that intermit the torque transfer between the outer clutch 15*b* and the inner clutch 15*c*.

The clutch 15 transmits torque only one way from the outer clutch 15*b* to the inner clutch 15*c* via the rollers 15*d*.

The pinion gear 16 is formed integrally with the inner clutch 15*c*, and is supported relatively rotation free by the perimeter of the output shaft 3 via the bearing 17.

The solenoid 5 and the switch 7 have a solenoid coil 18 and the switch coil 19, respectively, that forms an electromagnet by energization. A fixed iron core 20 is arranged between the solenoid coil 18 and the switch coil 19, and commonly used by both coils. In addition, a solenoid yoke 21 that covers the perimeter of the solenoid 5 and a switch yoke 22 that covers the perimeter of the switch 7 are formed continuously in the axial direction, providing integrally as one whole yoke.

Namely, as shown in FIG. 1, both the solenoid 5 and the switch 7 are arranged in the axial direction in series and constituted integrally, and are fixed to a starter housing 23 in parallel with the motor 2.

Figure 2:
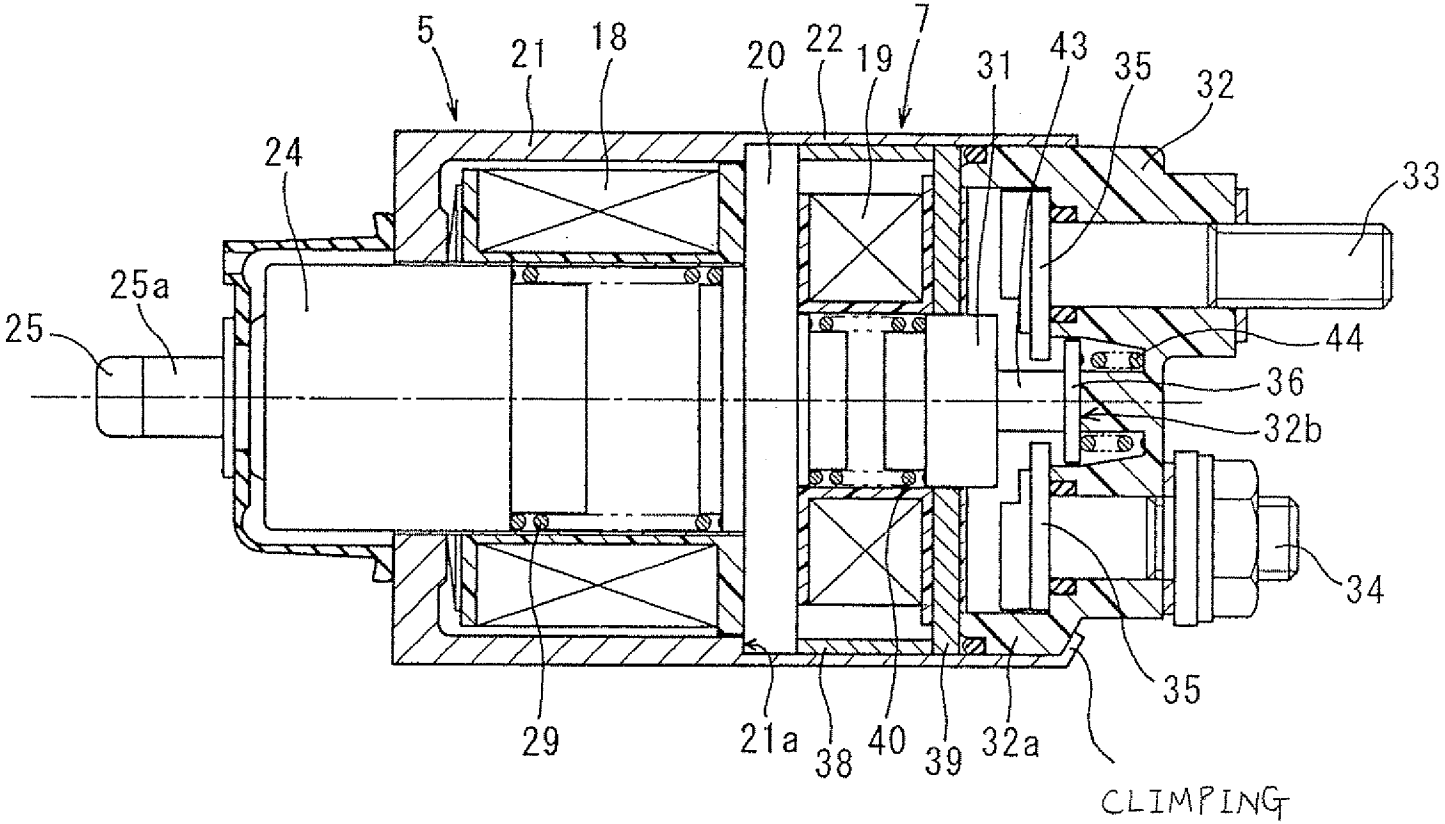
FIG. 2 shows a sectional view of a solenoid for pushing out a pinion and a switch for energizing the motor.

As shown in FIG. 2, the whole yoke has a bottomed cylindrical shape with a circular bottom surface at its end portion on an end side in the axial direction (the left-hand side in the drawing) and an opening in an opposite end side.

An outer diameter of the whole yoke from one end to the other in the axial direction has the same size, though the one end in the axial direction that forms the switch yoke 22 has a larger inner diameter and thinner edge than those of the solenoid yoke 21.

That is, a step portion 21*a* is provided in an inner circumference of the whole yoke between the one end in the axial direction that forms the solenoid yoke 21 and the other end in the axial direction that forms the switch yoke 22.

The fixed iron core 20 is inserted into the inside of the one end in the axial direction that forms the switch yoke 22 from an opening end (opening end of the switch yoke 22) that opens at the other end of the whole yoke.

The perimeter of an end surface of the fixed iron core 20 in the axial direction is contacted with the step portion 21*a* provided in the inner circumference of the whole yoke so that the position of the fixed iron core 20 in the axial direction is set.

Figure 3:
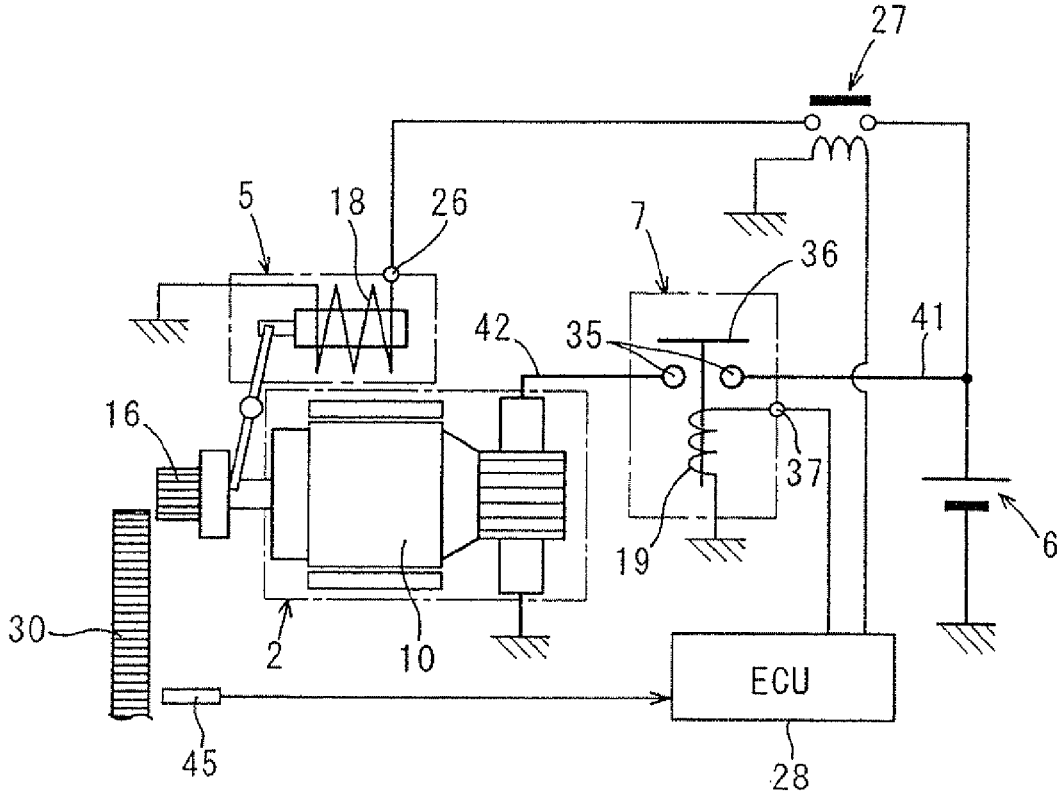
FIG. 3 shows an electric circuit of the starter.

Hereafter, the composition of the whole yoke (the solenoid yoke 21 and the switch yoke 22), the solenoids 5 and the switch 7 other than the fixed iron core 20 are explained with reference to FIGS. 2 and 3.

a) The solenoid 5 is constituted of the solenoid coil 18, a plunger 24, a joint 25 and the like. The solenoid coil 18 is arranged at the inner circumference of the one side in the axial direction of the whole yoke that forms the solenoid yoke 21. The plunger 24 that faces the fixed iron core 20 moves on the inner circumference of the solenoid coil 18 in the axial direction. The joint 25 transmits a motion of the plunger 24 to the shift lever 4.

One end of the solenoid coil 18 is connected to a connector terminal 26 (refer to FIG. 3), and the opposite end of the solenoid coil 18 is grounded by, for example, welded or etc. to the surface of the fixed iron core 20. An electric wiring that leads to a starter relay 27 is connected to the connector terminal 26.

The starter relay 27 is controlled on/off by an ECU 28 (Electrical Control Unit), and when the starter relay 27 is controlled on, the solenoid coil 18 is energized from the battery 6 through the starter relay 27.

When the fixed iron core 20 is magnetized by the energization to the solenoid coil 18, the fixed iron core 20 attracts the plunger 24 resisting a counterforce of a return spring 29, which is arranged between the plunger 24 and the fixed iron core 20.

When the energization to the solenoid coil 18 is stopped, the plunger 24 is pushed back in a direction away from the iron core (to the left in FIG. 2) by the counterforce of the return spring 29.

This plunger 24 is formed in a cylindrical shape having a cylindrical hole in its central part in a radial direction. The cylindrical hole opens to an end side in an axial direction of the plunger 24, and has a bottom in the opposite end side.

The joint 25 is inserted into the cylindrical hole of the plunger 24 with a drive spring (not shown).

The joint 25 is formed cylindrically. An engagement slot 25*a* with which one end of the shift lever 4 engages is formed on an end side of an end portion that projects from the cylindrical hole of the plunger 24, and a flange part is provided on an end side of the opposite end portion.

The flange part has an outer diameter that can slide on the inner circumference of the cylindrical hole, and is forced against the bottom of the cylindrical hole in response to the load of the drive spring.

After the end surface of the pinion gear 16 pushed out by the movement of the plunger 24 in the direction of an anti-motor side via the shift lever 4 contacts an end surface of the ring gear 30 attached to an engine crankshaft, the drive spring is compressed, while the plunger 24 moves until the fixed iron core 20 is attracted, and conserves the counterforce for making the ring gear 30 mesh with the pinion gear 16.

b) The switch 7 for motor energization is constituted of the switch coil 19, a movable iron core 31, a point-of-contact cover 32, the switch coil 19 arranged at the inner circumference of one end besides the direction of an axis of the whole yoke in which the switch 7 for motor energization forms the switch yoke 22, two terminal bolts 33 and 34, a set of fixed contacts 35, a movable contact 36, and the like.

The switch coil 19 is arranged inside of the one end in the axial direction of the whole yoke that forms the switch yoke 22. The movable iron core 31 counters the fixed iron core 20 and moves in the axial direction. The point-of-contact cover 32 made of resin closes an opening (opening of the switch yoke 22) opened at the other end side of the whole yoke and attached thereto.

The two terminal bolts 33 and 34 are fixed to the point-of-contact cover 32. The set of the fixed contacts 35 are fixed to the two terminal bolts 33 and 34. The movable contact 36 is intermittently bridges the set of the fixed contacts 35.

One end of the switch coil 19 is connected to an external terminal 37 (refer to FIG. 3), and the opposite end of the switch coil 19 is grounded by, for example, welded or etc. to the surface of the fixed iron core 20.

The external terminal 37 is formed projecting outside from an end surface of the point-of-contact cover 32, and an electric wiring that leads to the ECU 28 is connected.

An axial direction magnetic member 38 and a radial direction magnetic member 39 that form parts of magnetic path, i.e. magnetic path forming members, are arranged on a perimeter side in the radial direction of the switch coil 19 and on an anti-fixed iron core side in the axial direction of the switch coil 19, respectively.

The axial direction magnetic member 38 has a cylindrical shape, and inserted into the inner circumference of the switch yoke 22 with almost no crevice. The end surface of one end side in the axial direction of the axial direction magnetic member 38 contacts with the perimeter surface of the fixed iron core 20, and is positioned in the axial direction.

The radial direction magnetic member 39 is arranged perpendicular to the axial direction of the switch coil 19. The coil side position of the radial direction magnetic member 39 is suppressed by contacting a perimeter end surface of one end side in the axial direction to an end in the axial direction of the axial direction magnetic member 38.

The radial direction magnetic member 39 has a round hole opened in the radial center so that the movable iron core 31 can move in the axial direction.

When the fixed iron core 20 is magnetized by the energization to the switch coil 19, the movable iron core 31 is attracted to the fixed iron core resisting a counterforce of a return spring 40, which is arranged between the movable iron core 31 and the fixed iron core 20.

When the energization to the switch coil 19 is stopped, the movable iron core 31 is pushed back to an anti iron core direction (to the right in FIG. 2) by the counterforce of the return spring 40.

The point-of-contact cover 32 has a cylindrical leg 32*a*. The leg 32*a* is inserted in the inner circumference of one end side in the axial direction of the whole yoke in which the leg 32*a* forms the switch yoke 22. The leg 32*a* is arranged so that the end surface of the leg 32*a* contacts the surface of the radial direction magnetic member 39, and fixed to the opening end of the whole yoke by crimping.

Two terminal bolts 33 and 34 are a B terminal bolt 33 to which the battery cable 41 (refer to FIG. 3) is connected, and an M terminal bolt 34 to which the motor lead 42 (refer to FIGS. 1 and 3) is connected.

The set of fixed contacts 35 are formed separately to the two terminal bolts 33 and 34 (may be integrated), and are electrically fixed to the two terminal bolts 33 and 34 inside of the point-of-contact cover 32.

The movable contact 36 is arranged at the anti-movable iron core side (the right side in FIG. 2) than a set of fixed contacts 35, and is forced on the end surface of a rod 43 made of resin fixed to the movable iron core 31 in response to the load of the contact pressure spring 44.

However, since the initial load of the return spring 40 is set grater than the initial load of the contact pressure spring 44, when not energizing the switch coil 19, the movable contact 36 is in contact with an internal seat 32*b* of the point-of-contact cover 32 with the contact pressure spring 44 being contracted.

The motor point of contact is formed by the fixed contact 35 and the movable contact 36. The motor point of contact is closed by both the fixed contacts 35 being connected when the movable contact 36 pushed by the contact pressure spring contacts the set of fixed contacts 35. On the other hand, the motor point of contact is opened by both the fixed contacts 35 being disconnected when the movable contact 36 leaves the set of fixed contacts 35.

Next, an operation of the starter 1 is explained.

a) When performing the usual engine starting. When the user turns on an ignition switch (not shown) and starts the engine in the state where the engine has stopped completely.

The ECU 28 turns on the starter relay 27 in response to an engine-starting signal generated by turning on the ignition switch.

Thereby, the battery 6 energizes the solenoid coil 18 of the solenoid 5 for pushing out the pinion, and the magnetized fixed iron core 20 attracts the plunger 24, then the plunger 24 moves.

With the movement of the plunger 24, the pinion movable body is pushed out in the anti-motor side via the shift lever 4 and the end surface of the pinion gear 16 stops in contact with the end surface of the ring gear 30.

After a predetermined time, an ON signal is outputted from the ECU 28 from generating of the engine-starting signal to the switch coil 19 of the switch 7.

By this, the switch coil 19 is energized and the movable iron core 31 is attracted into the fixed iron core 20, and the motor point of contact closes by the movable contact 36 being pressed by the contact pressure spring 44 in contact with the set of fixed contacts 35.

Consequently, the motor 2 is energized and torque occurs in the armature 10, the torque is then transmitted to the output shaft 3, and rotation of the output shaft 3 is further transmitted to the pinion gear 16 via the clutch 15.

When the pinion gear 16 rotates to the position engageable to the ring gear 30, the pinion gear 16 engages to the ring gear 30 by the counterforce stored in the drive spring, and torque is transmitted to the ring gear 30 from the pinion gear 16 and the engine is started.

After the engine has started, the energization to the solenoid coil 18 of the solenoid 5 and the switch coil 19 of the switch 7 will be stopped by the OFF signal outputted from the ECU 28.

Consequently, the attractive force of the solenoid 5 disappears and the plunger 24 is pushed back. Then the pinion gear 16 separates from the ring gear 30, and retreats to the perimeter of the output shaft 3 with clutch 15 moving to a resting position (position shown in FIG. 1) and stops.

By the disappearance of the attractive force of the switch 7 and the movable iron core 31 being pushed back, the motor point of contact opens and the energization to the motor 2 from the battery 6 is stopped, and the rotation of the armature 10 gradually slows down and stops.

b) When an idle stop is carried out from an idling state.

When the condition (for example, a vehicle speed is zero and a brake pedal is stepped on) for making engine stop automatically from the idling state is satisfied, an engine stop signal will be outputted from the ECU 28, and a fuel injection and air supply to the engine will be stopped.

Thereby, the engine goes into a stopping process and the rotation of the ring gear 30 starts to reduce. When the rotation of the ring gear 30 falls to the predetermined number of rotations set beforehand, an ON signal will be outputted from the ECU 28 to the solenoid coil 18 of the solenoid 5. As shown in FIG. 3, sensor information is inputted into the ECU 28 from a number-of-rotations detection sensor 45 that detects the number of rotations of the ring gear 30.

After the pinion movable body is pushed out in the anti-motor side by the operation of the solenoid 5 and the end surface of the pinion gear 16 contacts the end surface of the ring gear 30, the engagement of the pinion gear 16 and the ring gear 30 is realized at the time when the ring gear 30 rotates to the position in which the pinion gear 16 is engageable.

Then, the ring gear 30 continues to reduce its rotation and finally stops, and the pinion gear 16 together with the ring gear 30 stop their rotation, maintaining the state where the pinion gear 16 is engaged to the ring gear 30.

In the meantime, a maintenance current that can hold the engagement state of the pinion gear 16 and the ring gear 30 is supplied in the solenoid coil 18 of the solenoid 5.

A process of engaging the pinion gear 16 to the ring gear 30 by operating the solenoid 5 during the rotation of the ring gear 30 in the process of stopping the engine is hereafter called "pinion pre-set".

While performing pinion pre-set, the switch coil 19 of the switch 7 is not energized.

c) Engine re-starting after pinion pre-set.

When the re-starting conditions for re-starting the engine are satisfied (for example, releasing the brakes by the user, shifting into a drive range, etc.), an ON signal from the ECU 28 is outputted to the switch coil 19 of the switch 7.

By this, the switch coil 19 is energized and the movable iron core 31 is attracted in the fixed iron core 20, and the motor point of contact closes by the movable contact 36 being pressed by the contact pressure spring 44 in contact with the set of fixed contacts 35.

Consequently, the motor 2 is energized from the battery 6 and torque occurs in the armature 10.

Since the pinion gear 16 has already engaged with the ring gear 30 at this time, the torque of the motor 2 is transmitted to the ring gear 30 via the pinion gear 16, and the engine is started.

(Effect of the First Embodiment)

Since the operations of the solenoid 5 and the switch 7 are separately controllable independently by the ECU 28, the starter 1 of the present embodiment can hold the state where the pinion gear 16 and the ring gear 30 are engaged, even after the rotation of the ring gear 30 has stopped by operating only the solenoid 5 to engage the pinion gear 16 to the ring gear 30 in case the engine is stopped from the idling state.

Then, when re-starting the engine, what is needed is to just operate the switch 7 and close the motor point of contact since the pinion gear 16 is already engaged with the ring gear 30.

That is, the time needed to engage the pinion gear 16 to the ring gear 30 can be shortened because it is not necessary to push out the pinion movable body when re-starting the engine, therefore re-starting of the engine can be performed promptly.

Since the solenoid 5 for pushing out the pinion and the switch 7 for energizing the motor are arranged in series in the axial direction in the starter 1 of the present embodiment, a size does not increase in the two directions in the radial direction of the motor 2.

Since the restrictions on the size in respect of assembly can be made small as compared with the starter of the prior art document that uses the solenoid 5 for pushing out the pinion and the switch 7 for energizing the motor in a position that is different in the circumferential direction of the motor 2, the ease of assembly to the vehicles improves.

In other words, positional flexibility equivalent to the conventional starter that performs the work of pushing out the pinion gear 16 and turning on and off the energization current of the motor 2 by using one electromagnetic switch is obtainable.

In addition, the fixed iron core 20 common to both the solenoid 5 and the switch 7 is arranged between the solenoid coil 18 and the switch coil 19, and the solenoid yoke 21 and the switch yoke 22 are formed integrally as the whole yoke.

Thereby, as compared with the case where the solenoid 5 and the switch 7 are constituted separately, the number of the parts can be reduced and the number of the assemblies can also be reduced.

Furthermore, the point-of-contact cover 32 can be fixed only by crimping the thinned opening end of the whole yoke, and the solenoid yoke 21 and the switch yoke 22 need not be crimped individually, because the solenoid yoke 21 and the switch yoke 22 are formed integrally as a whole yoke.

As compared with the case where crimping the solenoid yoke 21 and the switch yoke 22 individually, a process of cutting the inner circumference of the each yokes 21 and 22 to make the edge thin for providing the crimping portions to the ends of the each yokes 21 and 22 can be reduced, and a crimping process can also be lessened, thus workability can be improved by reduction of the number of manufacturing operations.

Although the thickness of the one end in the axial direction that forms the switch yoke 22 is formed more thinly than that of the solenoid yoke 21, a cross-section area of the magnetic path formed in the radial direction of the perimeter of the switch coil 19 can be enlarged by arranging the axial direction magnetic member 38 to the inner circumference of the one end in the axial direction being formed thin, thus performance reduction of the switch 7 by magnetic saturation can be prevented, and suitable performance can be obtained.

Further, the step portion 21*a* is provided between the one end in the axial direction that forms the solenoid yoke 21 and the other end in the axial direction that forms the switch yoke 22.

Since the step portion 21*a* provided in the inner circumference of the whole yoke can be used for positioning the fixed iron core 20 in the axial direction, the parts used for the solenoid 5 and the parts used for the switch 7 can be assembled precisely.

(Modification)

In the first embodiment, there is disclosed an example that closes the motor point of contact after pinion pre-set by operating the switch 7 when the engine re-starting conditions are satisfied after rotation of the ring gear 30 stops completely.

However, when the engine re-starting conditions are satisfied before rotation of the ring gear 30 stops after pinion pre-set, the engine can also be re-started before the ring gear 30 stops its rotation by operating the switch 7 and closing the motor point of contact at that time.

What is claimed is:

1. A starter for vehicles comprising:

a motor that generates torque by energization;

an output shaft that receives the torque of the motor and rotates;

a pinion movable body movably provided in an axial direction on a perimeter of the output shaft that has a pinion gear for transmitting the torque of the motor to a ring gear of an engine;

a solenoid for pushing out a pinion that pushes out the pinion movable body in the axial direction by using an attractive force of an electromagnet formed by energizing a solenoid coil; and a switch for energizing the motor that turns on and off an energization current of the motor by using an attractive force of an electromagnet formed by energizing a switch coil;

wherein, the starter controls operations of the solenoid and the switch separately and independently, the solenoid and the switch are arranged in the axial direction in series;

a fixed iron core common to both the solenoid and the switch is arranged between the solenoid coil and the switch coil;

a solenoid yoke that covers a perimeter of the solenoid and a switch yoke that covers a perimeter of the switch are formed integrally as a whole yoke;

the whole yoke has a bottomed cylindrical shape with a circular bottom surface at its end portion on an end side in an axial direction and an opening in an opposite end side;

the circular bottom surface where a plunger penetrates is formed integrally with the whole yoke;

the circular bottom surface is formed so that a thickness in the axial direction is thicker than a thickness of the whole yoke in a radial direction;

an outer diameter of the whole yoke from one end to an opposite end in the axial direction has the same size;

the end in the axial direction that forms the switch yoke has a thinner edge than that of the solenoid yoke;

a resin cover is fixed by crimping to an opening of the whole yoke where the thinner edge is provided;

a magnetic path forming member is arranged that forms a part of a magnetic path on a perimeter side in a radial direction of the switch coil in an inner circumference of the opening of the whole yoke where the thinner edge is provided; and an end surface of one end side in an axial direction of the magnetic path forming member contacts with a perimeter surface of the fixed iron core, and is positioned in the axial direction.

2. The starter for vehicles according to claim 1, wherein a step portion is provided in an inner circumference of the whole yoke between the one end in the axial direction that forms the solenoid yoke and the other end in the axial direction that forms the switch yoke;

the fixed iron core is inserted into the inside of the one end in the axial direction that forms the switch yoke from an opening end that opens at the other end of the whole yoke; and the perimeter of an end surface of the fixed iron core in the axial direction is contacted with the step portion provided in the inner circumference of the whole yoke so that the position of the fixed iron core in the axial direction is set.

3. The starter for vehicles according to claim 1, wherein a step portion is provided in an inner circumference of the whole yoke between the one end in the axial direction that forms the solenoid yoke and the other end in the axial direction that forms the switch yoke;

the fixed iron core is inserted into the inside of the one end in the axial direction that forms the switch yoke from an opening end that opens at the other end of the whole yoke; and the perimeter of an end surface of the fixed iron core in the axial direction is contacted with the step portion provided in the inner circumference of the whole yoke so that the position of the fixed iron core in the axial direction is set.

* * * * *